United States Patent [19]

Quinci et al.

[11] 4,375,190

[45] Mar. 1, 1983

[54] PRINTING PRESS HAVING A PLURALITY OF PRINTING STATIONS

[75] Inventors: Emanuel Quinci, Dix Hills; Clement R. Konars, Glen Cove, both of N.Y.

[73] Assignee: Halm Instrument Co., Inc., Glen Head, N.Y.

[21] Appl. No.: 165,711

[22] Filed: Jul. 3, 1980

[51] Int. Cl.[3] ..... B41F 5/18

[52] U.S. Cl. ..... 101/177; 101/185; 101/234; 101/246; 101/247; 101/349

[58] Field of Search ..... 101/174, 177 I, 182, 101/178, 183, 184, 185, 136, 137, 140, 233, 234, 247, 246, 349, 350, 409, 410, 411, 412, 206, 207; 29/116 R

[56] References Cited

U.S. PATENT DOCUMENTS

| | | | |
|---|---|---|---|
| 1,653,198 | 12/1927 | Belcher | 101/174 X |
| 2,392,391 | 1/1946 | Kaddeland | 101/184 |
| 2,525,931 | 10/1950 | Morse | 29/116 R |
| 3,190,218 | 6/1965 | Willard | 101/184 X |
| 3,191,530 | 6/1965 | Fath et al. | 101/184 |
| 3,521,554 | 7/1970 | Zurick | 101/247 X |
| 3,595,164 | 7/1971 | Hovekamp | 101/185 X |
| 3,768,406 | 10/1973 | Gutsche et al. | 101/409 |
| 3,869,983 | 3/1975 | Garber et al. | 101/181 X |

FOREIGN PATENT DOCUMENTS

| | | | |
|---|---|---|---|
| 2341510 | 4/1974 | Fed. Rep. of Germany | 101/183 |

*Primary Examiner*—Edgar S. Burr
*Assistant Examiner*—Moshe I. Cohen
*Attorney, Agent, or Firm*—James P. Malone

[57] ABSTRACT

Paper gripper improvement in a printing press of the type having a frame, a large paper carrying impression cylinder drum mounted on the frame and a plurality of retractable printing stations mounted on the frame and spaced around the drum. Each gripper has a stationary finger and a second finger reciprocatable with respect to the stationary finger. A cam is connected to operate the reciprocatable finger to grip the paper as it is fed onto the drum. To detect a missing paper, an electrical circuit is completed by contact between the stationary finger and the reciprocatable finger in the absence of a paper between them insulating them from each other, whereby the need for photo-cells or other detectors to detect missing papers is eliminated. The inking rollers are driven separately from the drum to facilitate retracting the printing stations in the event of a missing paper.

3 Claims, 10 Drawing Figures

PRINTING PRESS HAVING A PLURALITY OF PRINTING STATIONS

TECHNICAL FIELD

This invention relates to printing presses having a plurality of printing stations and more particularly to multi-color printing presses.

BACKGROUND ART

Conventional multi-color printing presses generally have a large paper carrying drum which rotates past a plurality of printing stations. For instance, in a four color press there would be four printing stations.

One of the problems with this type of press is the difficulty in obtaining and maintaining positive gripping of the papers so as to maintain accurate registration of the four different colors.

Another problem occurs when a paper is missed or dropped and does not appear on the drum, leaving an empty space on the paper carrying drum. In that event it is necessary to retract the printing stations so that the inked rollers normally running in contact with the drum will not print on the drum. In conventional printing presses, missing papers are detected with photo-electric sensors which involve a complicated and expensive detection system.

Another problem with this type of printing press is that in conventional printing presses the printing and inking rollers at the separate printing stations are driven by the paper carrying drum. In conventional printing presses having printing fountains at the printing stations which are retracted by lifting them out of contact with the drum, the inertia of all the inking rollers limits the speed of the retracting motion. Since perfect registration of the different colors is probably the most important thing in a multi-color press it is necessary that the registration of the printing rollers be positively controlled.

THE PRESENT INVENTION

The present invention provides a new and improved gripping means for gripping the papers on the drum so that positive registration is obtained and maintained during the printing of the four colors.

With respect to the problem of missed paper, the gripping device comprises two conductive fingers so that if a paper is missed or dropped, a circuit is completed which will lift the inked rollers out of contact with the printing drum.

The present invention solves the problem of the inertia of the inking rollers by driving the inking rollers separately and independently from the rollers at the printing stations.

The present invention provides positive registration of the printing rollers by eliminating any friction drive and positively gearing the printing rollers to the main gear drive of the printing press.

OBJECTS OF THE INVENTION

Accordingly, a principal object of the invention is to provide a new and improved printing press having a plurality of printing stations.

Another object of the invention is to provide a new and improved printing press having a plurality of printing stations having new and improved means to grip the papers.

Another object of the invention is to provide a new and improved printing press having a plurality of printing stations having new and improved means to grip the papers wherein the fingers, in the absence of a paper, complete a control circuit which retracts the inked rollers from the paper carrying drum as the empty space on the paper carrying drum passes each printing station.

Another object of the invention is to provide a new and improved driving means for the plurality of printing stations which provides positive registration of all of the printing cylinders.

Another object of the invention is to provide in a printing press of the type having a frame, a large paper carrying impression cylinder drum mounted on the frame and a plurality of printing stations mounted on the frame and spaced around the drum; means to positively grip papers on said drum comprising at least one gripper having a stationary finger and a second finger reciprocatable with respect to the stationary finger, and cam means connected to operate the reciprocatable finger to grip a paper as it is fed onto the drum.

BEST MODE OF THE INVENTION

Figure 1:
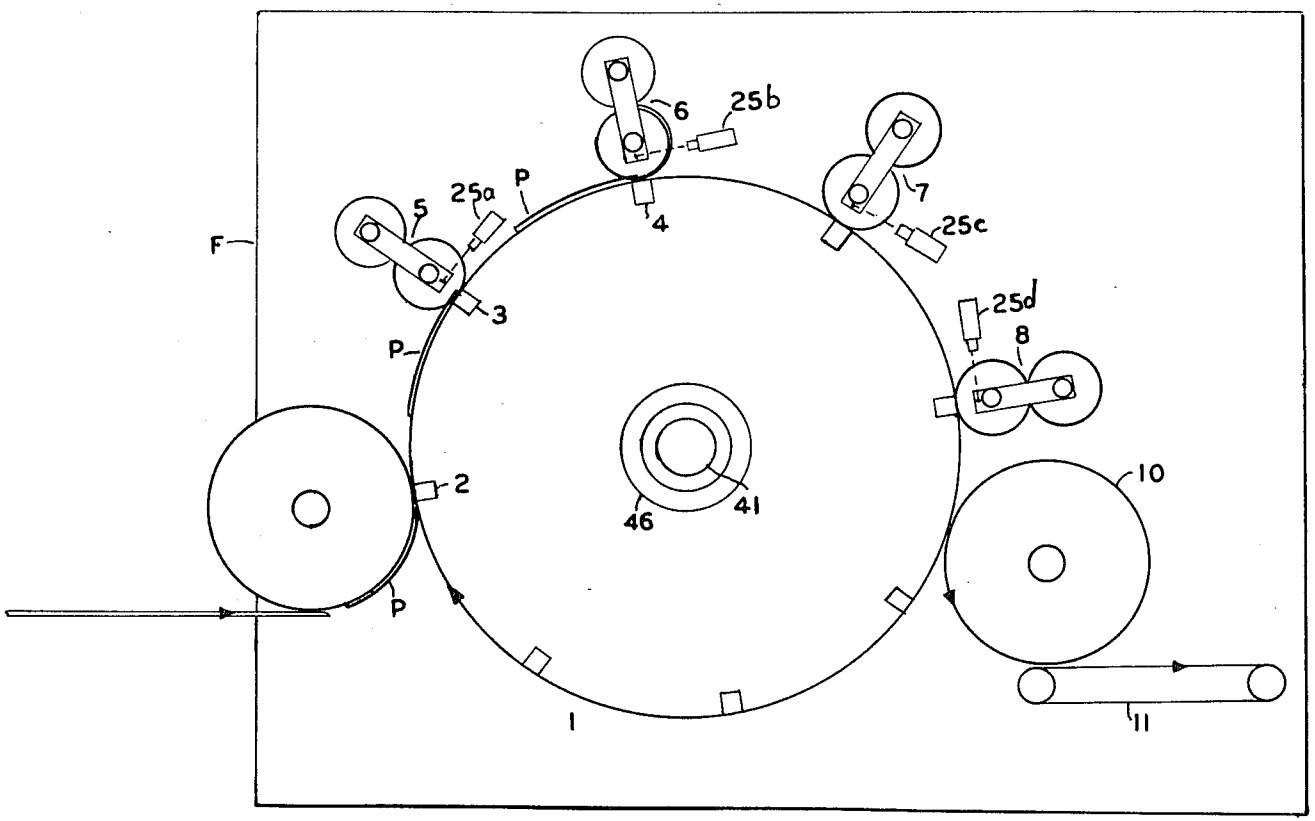
FIGS. 1 and 1A are schematic diagrams of an embodiment of the invention.

Referring to the figures, FIG. 1 shows a schematic diagram of an embodiment of the invention. Papers P are fed to a large drum 1, on driven shaft 41, which contains eight paper grippers 2, 3, 4, etc. The drum carries the papers past the printing stations 5, 6, 7,8. The papers are taken from the drum by the delivery cylinder 10 which may be a vacuum type device. The papers are then passed on to a delivery belt 11.

Figure 1A:
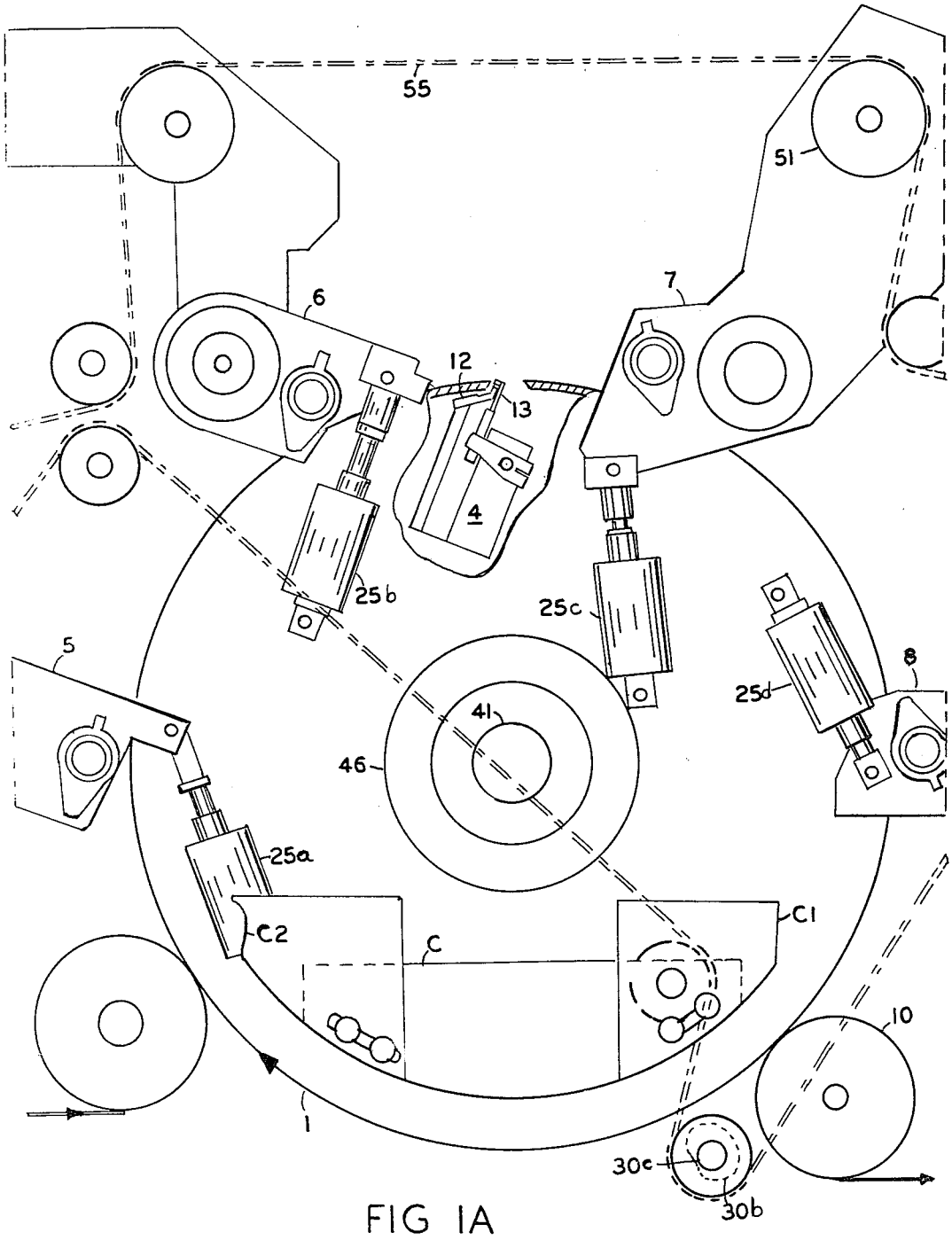

The fingers of the grippers are opened by stationary cam C, FIG. 1A. Cam segment C1 opens the gripper fingers to release the papers and cam segment C2 closes the gripper fingers to carry the papers. Cam segments C1 and C2 are adjustable.

FIG. 1A is similar to FIG. 1 with additional detail. The gripper assemblies 2, 3, 4, etc. of FIG. 1 are mounted inside the drum 1, there are eight equally spaced grippers. The grippers are operated by cam C. Cam segment C1 opens the grippers to release the papers. Cam segment C2 closes the grippers to hold the papers. Insulating strip 19 insulates the stationary finger 12 from the lip of drum 1.

Timing belt 55 provides a separate drive for the inking rollers on all the printing stations. It is driven by the timing belt puller on a drive shaft **30*c* which also mounts the timing cams 30*b*, 31*b*, 32*b*, 33*b* of FIG. 9**. Therefore, the inertia of the inking rollers does not impede the retraction of the printing fountain in the event of a missing paper.

Figure 2:
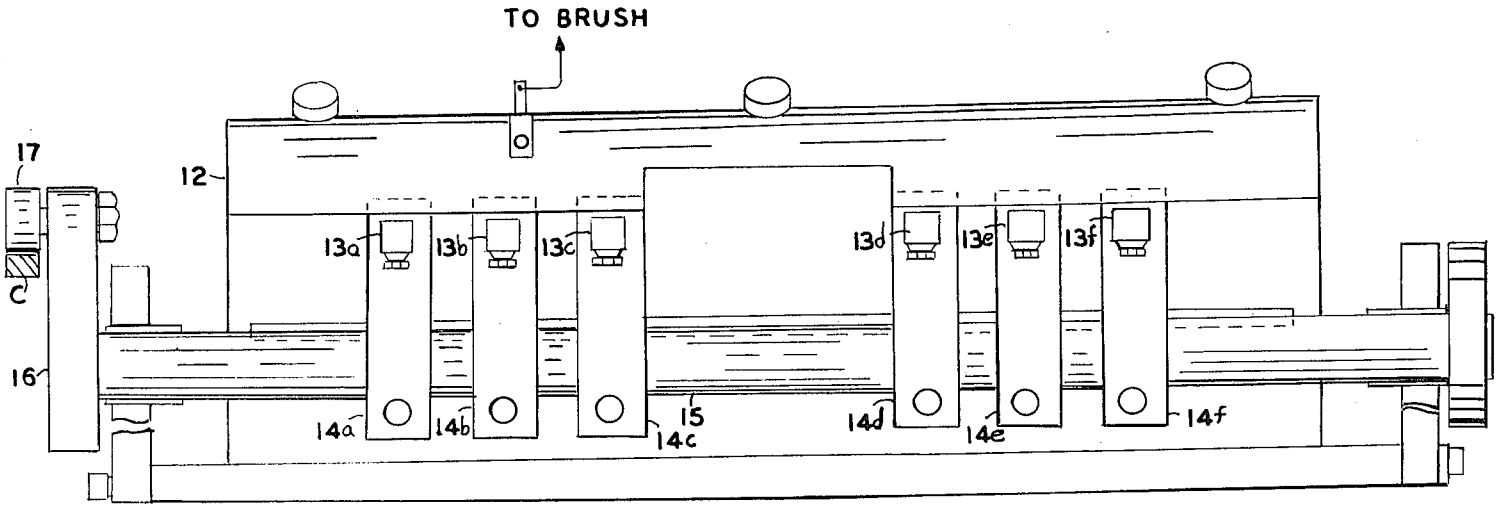
FIG. 2 is a side detail view of the gripper mechanism.

FIG. 2 shows a side view of a gripper assembly.

Figure 3:
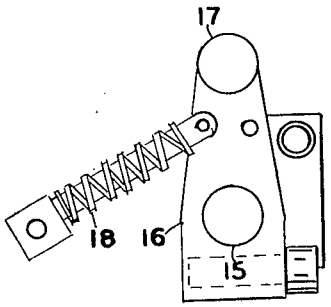
FIG. 3 is a side view of the cam follower of the gripping mechanism.

FIG. 3 shows an end view of the cam control for the gripper fingers.

Figure 4:
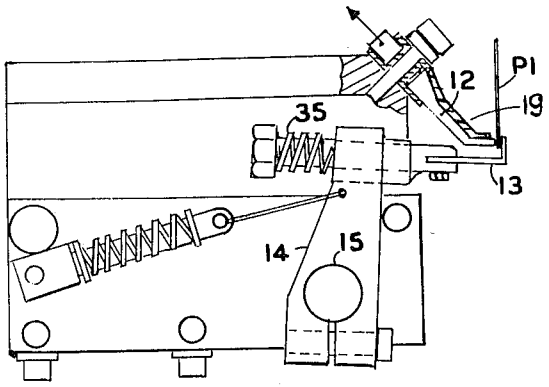
FIG. 4 is a detail view of the gripper finger assembly.

FIG. 4 shows an end view.

Referring more specifically to FIG. 4, each gripper assembly comprises a stationary finger 12 and a moving finger 13 having a perpendicular end portion so that the paper P1 is gripped between the two fingers. The moving finger 13 is mounted on an arm 14 which is fixedly mounted on the shaft 15. The arm 14 is spring loaded by the spring 18 to hold the fingers in closed position. The shaft 15 is operated by a cam C, as will be explained, to open the gripping fingers at the proper times to receive and grip the leading edge of a paper and to release it after printing. Spring 35 will absorb the shock of the gripper closing and equalizing the pressure on the document between one gripper and the next.

Referring to FIG. 2 there are six arms, 14*a* to 14*f* and six movable fingers 13*a* to 13*f*. The arms are mounted on the shaft 15, which is opened and closed at the proper times by means of the arm 16 and cam follower 17. The cam follower arm 16 is spring loaded by the spring 18. The cam follower 17 rides on the cam C and is actuated by cam segments C1 and C2, of FIG. 1A. The number of arms could change depending on the size of the documents.

Figure 5:
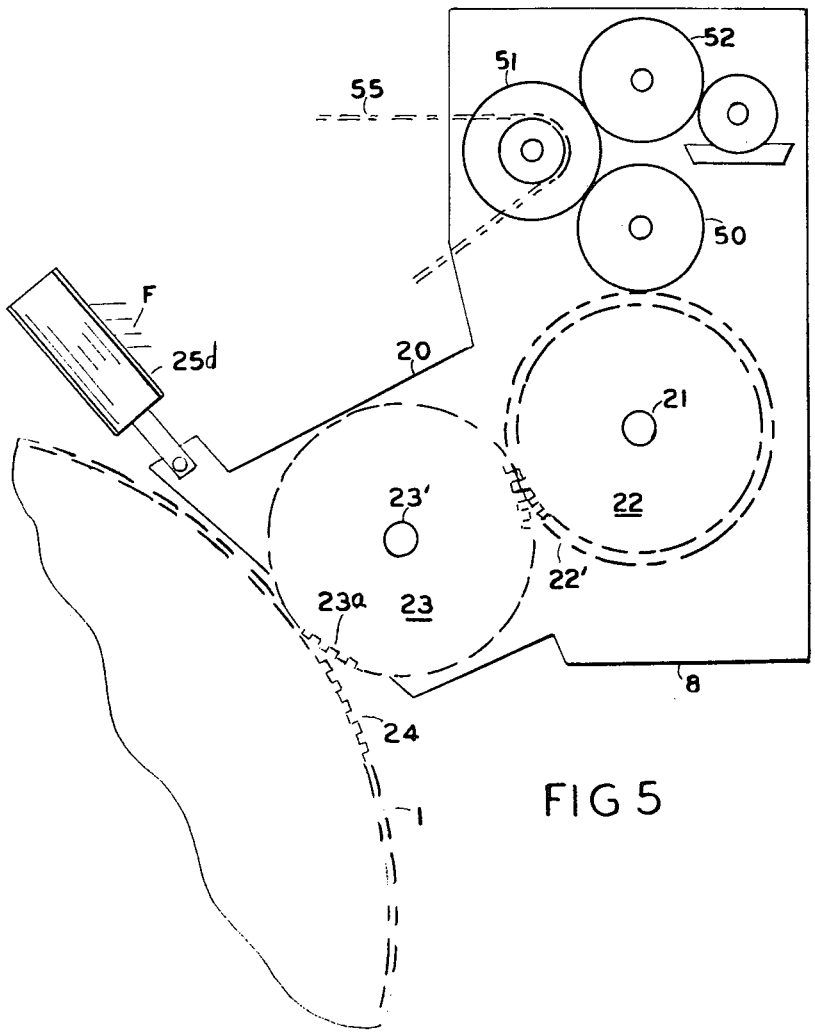
FIG. 5 is a detail view of the printing station assembly.

FIG. 5 shows a side view of one of the printing stations with one side frame removed. Each printing station comprises a frame 20, which is pivotally mounted on the frame F of the machine by means of the shaft 21. Also mounted on the shaft 21 is a plate cylinder 22 and a gear 22'. The blanket cylinder 23 is mounted on the shaft 23', which is mounted on the frame 20. Also mounted on the shaft 23' is a gear 23*a* which meshes with the gear 22'. The gear 23*a* is driven by the gear 24 which is mounted on the drum 1. Attached to the frame 20 is a solenoid operated air cylinder 25, which is fixedly mounted on the frame F of the printing press. When a missing paper is detected, the air cylinder 25 is actuated to rotate the frame 20, and lift the blanket cylinders out of contact with the paper carrying drum 1, in sequence, as the empty space on the drum passes under the respective printing cylinders.

In most presses the inking rollers 50, 51, 52, etc., are driven from the plate cylinder gear. In our design, the inking rollers are driven from the main drive by timing belt 55 thus removing the additional load from the plate cylinder gears. This will allow quicker movement of the blanket cylinder, when being retracted. There is no gear connection between the inking rollers and the plate cylinder.

Figures 6, 7, 8:
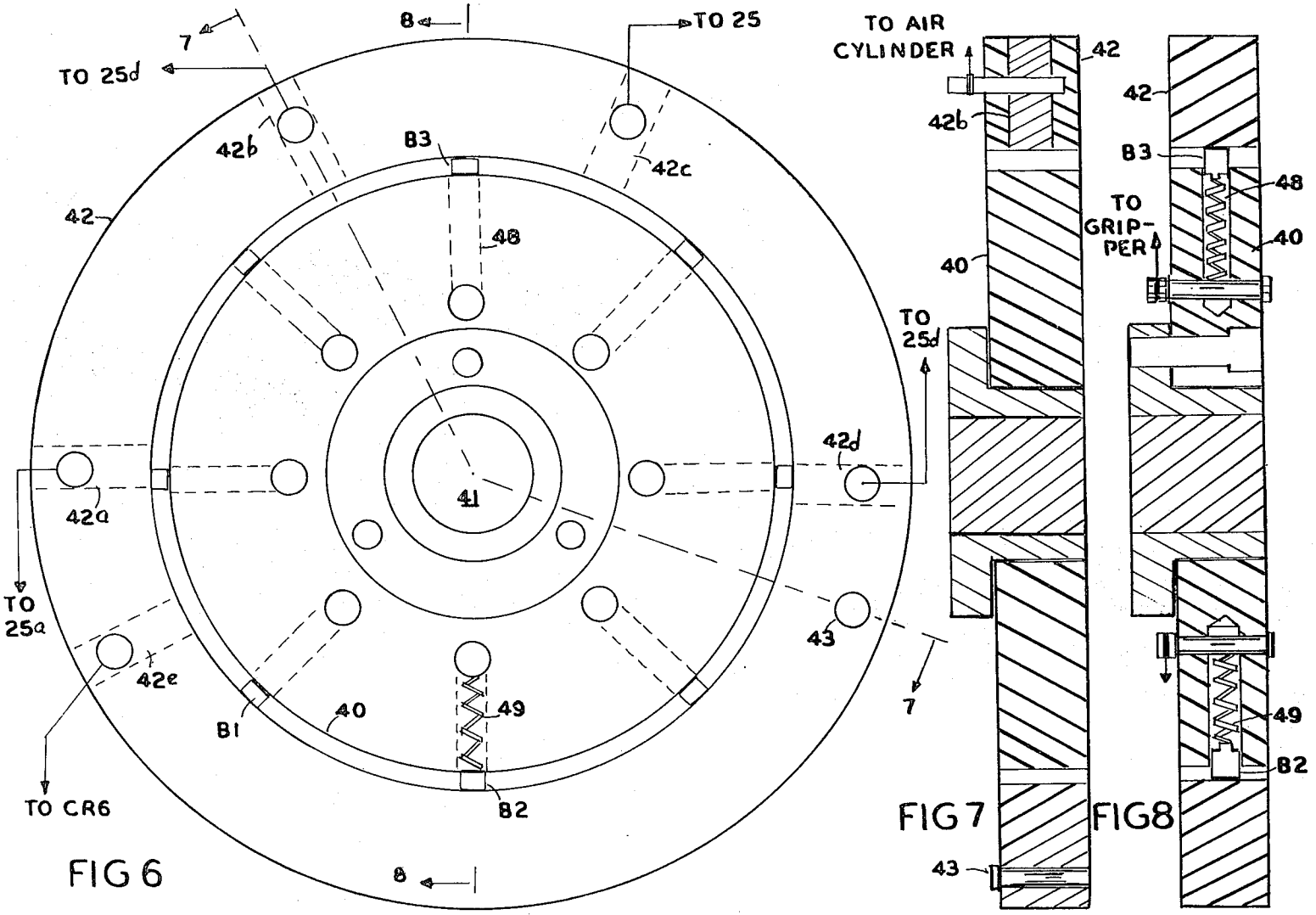
FIG. 6 is a detail view of the commutator assembly.
FIG. 7 is a sectional view taken along the line 7—7 of FIG. 6.
FIG. 8 is a sectional view taken along the line 8—8 of FIG. 6.

FIG. 6 shows the commutator or distributor for actuating the air cylinders to retract the printing frames. The distributor comprises a moving portion 40 which is mounted on the main shaft 41, which rotates the paper carrying drum 1. Mounted on the moving portion 40 are eight brushes B1, B2, B3, etc., each one of which is connected to one of the eight gripper contacts. The brushes rotate in contact with the stationary ring 42, which has a number of contacts 42*a*, 42*b*, 42*c*, 42*d*, etc., which are insulated from each other by insulator ring 46. Each one of the contacts is connected to one of the solenoids 30 to 33 of FIG. 9 and the solenoids are connected to actuate the respective air cylinders 25*a*, 25*b*, 25*c*, 25*d*.

FIG. 7 shows a sectional view taken along the lines 7—7 of FIG. 6. The stationary ring 42 is mounted to the frame by screws 43. The moving segment 40 is mounted on the shaft 41. The fixed insulation ring 46 has a plurality of contacts, so that as the brushes B1, B2, etc., ride past contacts the circuits through gripper contacts are connected to the air cylinders 25*a*, 25*b*, etc. As a brush connected to a particular gripper where there is a missing paper, rides around, it contacts the fixed contacts at the proper times so that the air cylinders are actuated to lift the respective printing frame in sequence as the empty space on the drum passes each printing station. A contact is connected to stop the machine, as will be explained.

FIG. 8 is a sectional view taken along the line 8—8 of FIG. 6. FIG. 8 illustrates the mounting of the brushes B2, B3, etc. The brushes are mounted in the moving portion 40 of the commutator and are spring loaded by the springs 48, 49, etc.

Figure 9:
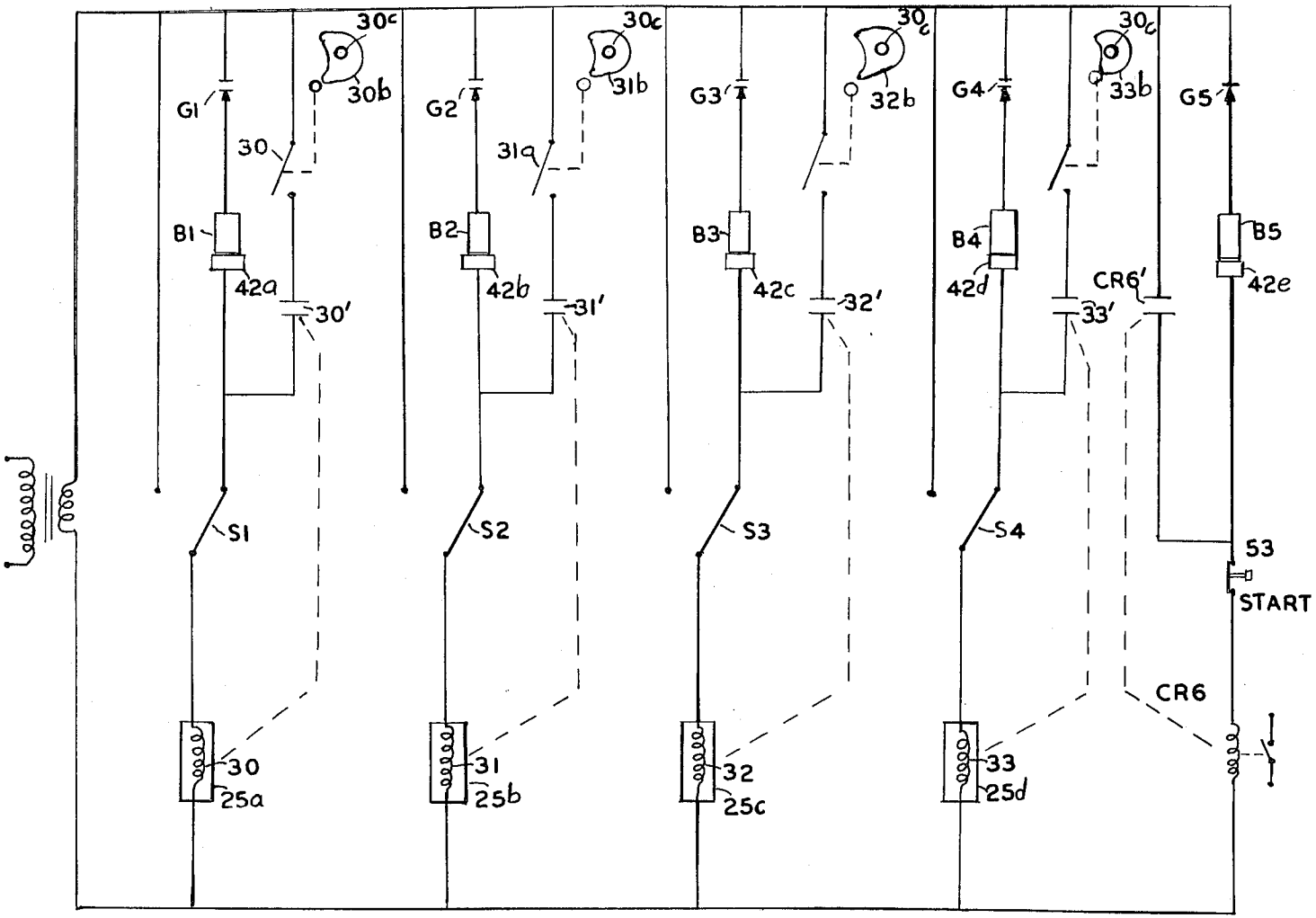
FIG. 9 is a schematic circuit diagram.

FIG. 9 shows a circuit for lifting the printing stations out of contact with the drum 1, in the proper sequence. Since there are at least four papers normally travelling on the drum at one time, if one of the papers is missed, the four printing stations must be successively lifted as the empty space on the drum passes each one of them. FIG. 9 shows a circuit for accomplishing this. When a paper is missing, its gripper contacts G1, G2, G3 or G4, will make contact because the paper is missing. If the paper is picked up in normal operation the paper will insulate the two contacts.

The gripper contacts are connected to respective brushes B1, B2, B3 and B4. The brushes ride on a commutator ring having stationary contacts 42*a*, 42*b*, 42*c* and 42*d*. The stationary contacts are connected through the switches S1, S2, S3 and S4, to the solenoids 30, 31, 32, 33. Each one of the solenoids is connected to operate one of the air cylinders 25*a* to 25*d*, of FIG. 5. Therefore, when a paper is missing, one of the gripper contacts is completed so that as the drum rotates, the successive air cylinders are energized by the valve solenoids 30, 31, etc., which lift the individual printing frames as the empty space of the drum passes under the respective printing stations.

Contacts 30'–33' complete holding circuits. The holding circuits are opened by switches 30*a*, 31*a*, etc., which are opened by cams 30*b*, 31*b*, etc., which are set to time the trailing ends of the papers. Cams 30*b*, 31*b*, etc., are on shaft 30*c*, FIG. 1.

Contact 42*e* of the distributor is the first segment that the paper traverses. If there is no paper at this point the circuit is completed through the segment 42*e* to the solenoid CR6 which stops the machine. Contact CR6' is a holding circuit. After the condition has been corrected the machine may be started by pushing in the start button 53.

It is claimed:

1. In a printing press of the type having a frame, a large paper carrying impression cylinder drum mounted on the frame and a plurality of printing stations mounted on the frame and spaced around the drum:

means to positively grip papers on said drum comprising at least one gripper having a stationary finger and a second finger reciprocatable with respect to the stationary finger, and cam means connected to operate the reciprocatable finger to grip a paper as it is fed onto the drum, the reciprocatable finger being spring loaded to absorb shock, wherein each printing station has a printing roller normally in contact with said drum, means to pivotally mount the printing rollers on the frame, means to pivotally move the printing rollers with respect to the surface of the drum and means to detect a missing paper comprising an electrical circuit completed by contact between the stationary finger and the reciprocatable finger in the absence of a paper between them insulating said fingers from each other, each printing station having a plurality of inking rollers, and a timing belt connected to drive the inking rollers independently of the printing rollers.

2. Apparatus as in claim 1 having a plurality of grippers, a plurality of solenoid valve operated pressure cylinders each connected to rotate a printing roller out of contact with the drum, and distributor means connected between the grippers and the solenoids to successively rotate the printing rollers out of contact with the drum as a gripper with no paper passes under the successive printing rollers.

3. Printing station means for a printing press of the type having a frame, a large paper carrying drum, a plurality of printing stations mounted on the frame and spaced about the drum and printing press drive means connected to rotate the drum:

wherein each printing station comprises a printing station frame rotatably mounted on the printing press frame, a blanket cylinder rotatably mounted in the printing press frame and normally running in contact with the surface of the drum, a plate cylinder rotatably mounted in the printing station frame, a first gear connected to the blanket cylinder, a second gear connected to the plate cylinder and meshing with the first gear, the printing station frame being rotatably mounted to rotate about the axis of the plate cylinder and second gear, a third gear mounted on the drum and meshing with the first gear, the third gear being driven by the printing press drive means, whereby the printing stations are positively driven by the printing press drive means and do not depend upon any friction drive, each printing station having a plurality of inking rollers, and a timing belt connected to drive the inking rollers independently of the printing rollers.

* * * * *